US007322466B2

(12) United States Patent
Alonso

(10) Patent No.: US 7,322,466 B2
(45) Date of Patent: Jan. 29, 2008

(54) CONTAINER WITH PROMOTIONAL BASE

(76) Inventor: Armando Diaz Alonso, Paseo Pok Ta Pok, #27, Casa 4, Zona Hotelera, Cancun, Quintana Roo (MX) 75000

( * ) Notice: Subject to any disclaimer, the term of this patent is extended or adjusted under 35 U.S.C. 154(b) by 513 days.

(21) Appl. No.: 10/971,595

(22) Filed: Oct. 22, 2004

(65) Prior Publication Data

US 2005/0194269 A1 Sep. 8, 2005

(51) Int. Cl.
*B65D 77/00* (2006.01)

(52) U.S. Cl. ..... 206/217; 206/457

(58) Field of Classification Search ..... 206/217, 206/457; 40/306, 324; 215/6
See application file for complete search history.

(56) References Cited

U.S. PATENT DOCUMENTS

| | | | | | |
|---|---|---|---|---|---|
| 2,996,208 | A | * | 8/1961 | Schroeder | 215/377 |
| 3,051,303 | A | * | 8/1962 | Daanen et al. | 206/776 |
| 4,416,370 | A | * | 11/1983 | Beall | 206/217 |
| D301,003 | S | * | 5/1989 | Burns | D7/515 |
| 5,165,546 | A | * | 11/1992 | Jaeger et al. | 206/534 |
| 5,419,436 | A | * | 5/1995 | Powell | 206/519 |
| 5,487,486 | A | * | 1/1996 | Meneo | 220/504 |
| 5,553,735 | A | * | 9/1996 | Kimura | 362/101 |
| D387,615 | S | * | 12/1997 | Wilson et al. | D7/396.6 |
| D400,395 | S | * | 11/1998 | Wilson | D7/396.6 |
| 5,842,590 | A | * | 12/1998 | Gordon et al. | 215/10 |
| D416,173 | S | * | 11/1999 | Hersch | D7/514 |
| 5,996,781 | A | * | 12/1999 | Glaser et al. | 206/217 |
| D420,256 | S | * | 2/2000 | Hersch | D7/515 |
| 6,155,411 | A | * | 12/2000 | Ho | 206/77.1 |
| 7,140,504 | B1 | * | 11/2006 | Baron | 215/6 |
| 2004/0055920 | A1 | * | 3/2004 | Perez | 206/457 |
| 2004/0134919 | A1 | * | 7/2004 | Irwin et al. | 220/630 |
| 2005/0061687 | A1 | * | 3/2005 | Coppola | 206/217 |

* cited by examiner

*Primary Examiner*—David T. Fidel
(74) *Attorney, Agent, or Firm*—Anderson Kill & Olick, PC

(57) ABSTRACT

The present application refers to a container comprising a cup, a joint and a base, wherein the latter defines a cavity where a lid is coupled to form a cavity, allowing the placement of an object that may be a decorative figure, a toy or a promotional means. In another embodiment, the base of the container is shaped to represent an object.

10 Claims, 10 Drawing Sheets

CONTAINER WITH PROMOTIONAL BASE

BACKGROUND OF THE INVENTION

The present invention is related to containers of the type called yard, cup, glass or the like, intended not only to contain a beverage but to have a nice look to the consumer. Likewise, it is intended to create new forms of containers bearing advertising and promotional signs for products, brands, gifts, decorative elements, etc. to be easily transmitted to the consumer in a cheap and attractive fashion. Likewise, certain attempts have been made to provide a consumer with non-disposable containers to be kept upon consuming the beverage, including promotions to refill the beverage, change the outside of the container and to decorate the outside of the container, so that the user may keep the container and use it at home. In this regard, it is advisable to provide new and attractive forms of containers with an attractive look that may encourage users to keep them. Furthermore it is common that restaurants, bars, stadiums, cinemas, etc., may tend to provide container bearing certain promotional or advertising materials. In general, these containers require much space for transportation and storage purposes, which increase the costs thereof. Thus, it is advisable to have containers occupying minimum space, so that a large number may be transported and stored in a reduced space. The applicant has filed two patent applications on similar methods, to which File PA/u/2004/000056, Folio PA/E/2004/010846, and File PA/u/2004/000139, File PA/E/2004/034732, dated Mar. 3, 2004 and Jul. 7, 2004, respectively, were assigned.

SUMMARY OF THE INVENTION

One object of the invention is to provide a reusable container with a base related to certain types of promotion that may be attractive to the user.

One embodiment of the invention provides a container with a promotional base comprising an upper part or cup (2) formed from an enlarged hollow body which defines a cavity where the beverage shall be containerized with said upper part having one end which is open and a closed opposite end, a lower part (4), a joint (3) that couples the upper part to the lower part of the base of the container wherein the lower part includes a cavity (6), adapted to contain promotional means within the cavity of said base of the container and a lid forming a removable bottom to the cavity of said base. This container does not occupy much space for storage or transportation and may be easily assembled.

These and other objects of the invention shall be further detailed based on the following drawings.

BRIEF DESCRIPTION OF THE DRAWINGS

In order that the invention can be clearly understood and put into practical effect the invention will now be described with reference to the accompanying drawings which illustrate non-limiting embodiments of the present invention, and wherein.

DETAILED DESCRIPTION OF THE INVENTION

The aforementioned objects of the invention are accomplished by means of the invention shown on FIGS. 1 to 8, for which purpose references and terms have been assigned for each part of the depicted container. In this way, the preferential form of the container and the making of the invention and diverse embodiments of this container are referred to herein.

Figure 1:
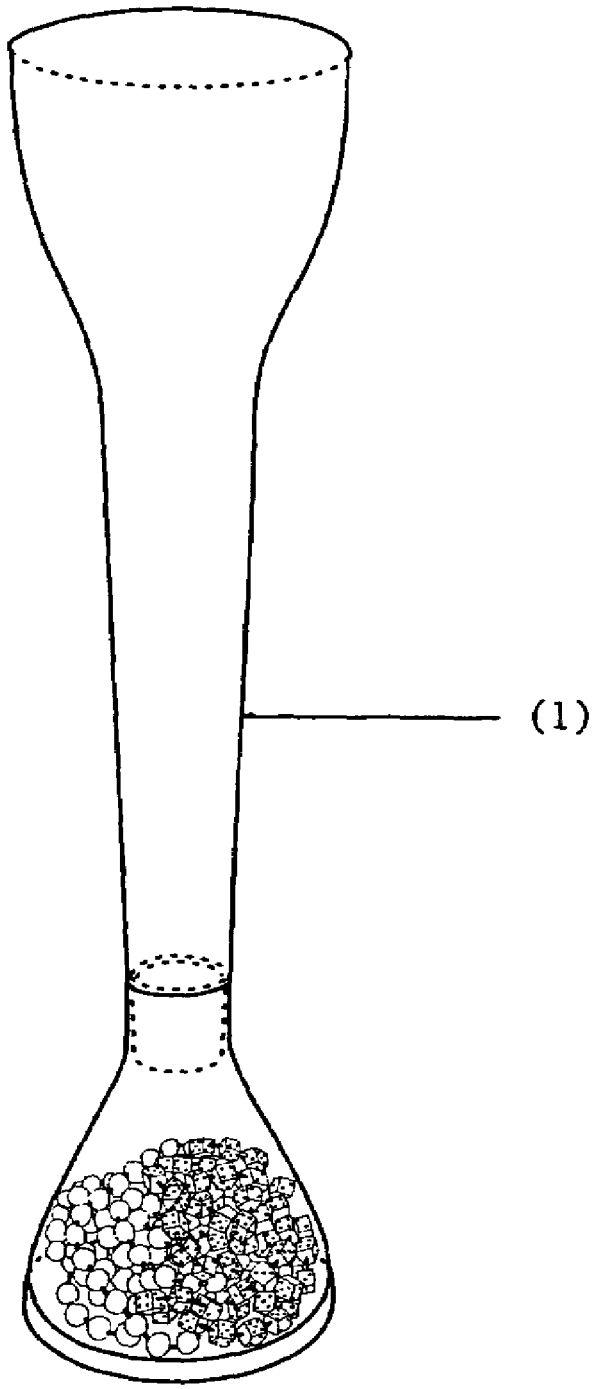
FIG. 1 is a perspective view of the container according to an embodiment of the present invention.

FIG. 1 shows a first embodiment of the container according to the present invention, depicting a container (1) preferentially called yard, which is formed from one single piece made of plastic, glass, etc., comprising a cup (2), a joint (3) and a base (4), the upper part of the yard formed from an enlarged body with a bottom part and an open-end upper part whose inner part defines a cavity wherein the beverage shall be containerized, in a cup-shaped form with a circular section that widens from the base towards the upper part, which cavity has a bottom defined by a wall in the joint (3), the base of the container (4) that defines a cavity (6) where a promotional means shall be placed, which may be an object or good as described below; a lid (5) couples to the lower part of the container, which lid shall be utilized as support to place an object or good and may be fixed to the container through pressure. Likewise, experts may vary the configuration of the cup (2) of the container shown in FIG. 1, and contain the beverage too, e.g., it may be a section shaped in the form of a quadrangle, oval, triangle, circle, or otherwise geometrical figure. Likewise, the container may be transparent or colored.

Figure 2:
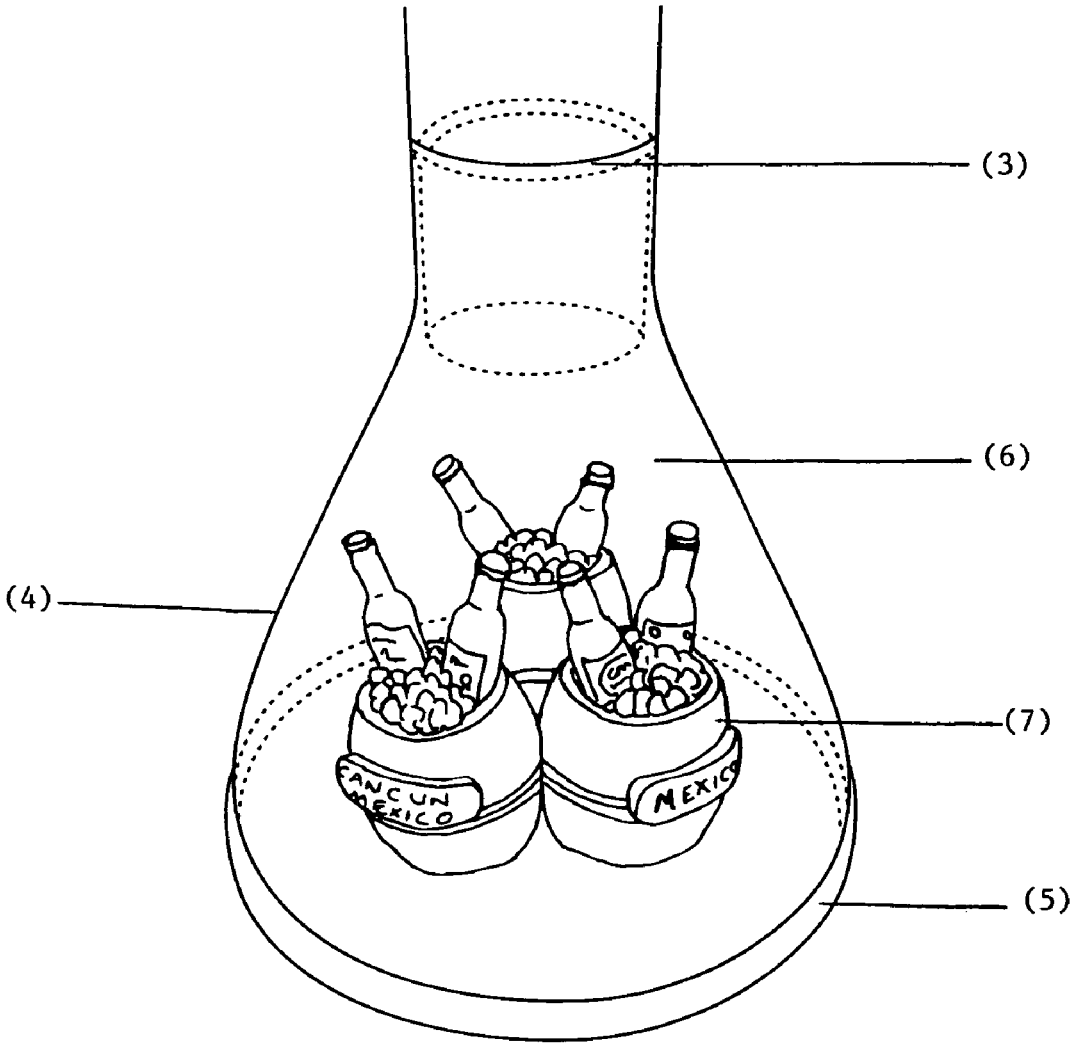
FIG. 2 is a detailed view of the base of the container shown on FIG. 1.

FIG. 2 shows the base of the container in a detailed fashion, the cavity (6) of the base may be noted closed in the lower part by the lid (5), an object (7) may be placed in the cavity, whether a decorative object, a toy, or a device shedding light or blinking color lights; furthermore, the lid may be decorated, e.g., with a promotional brand.

Figure 3:
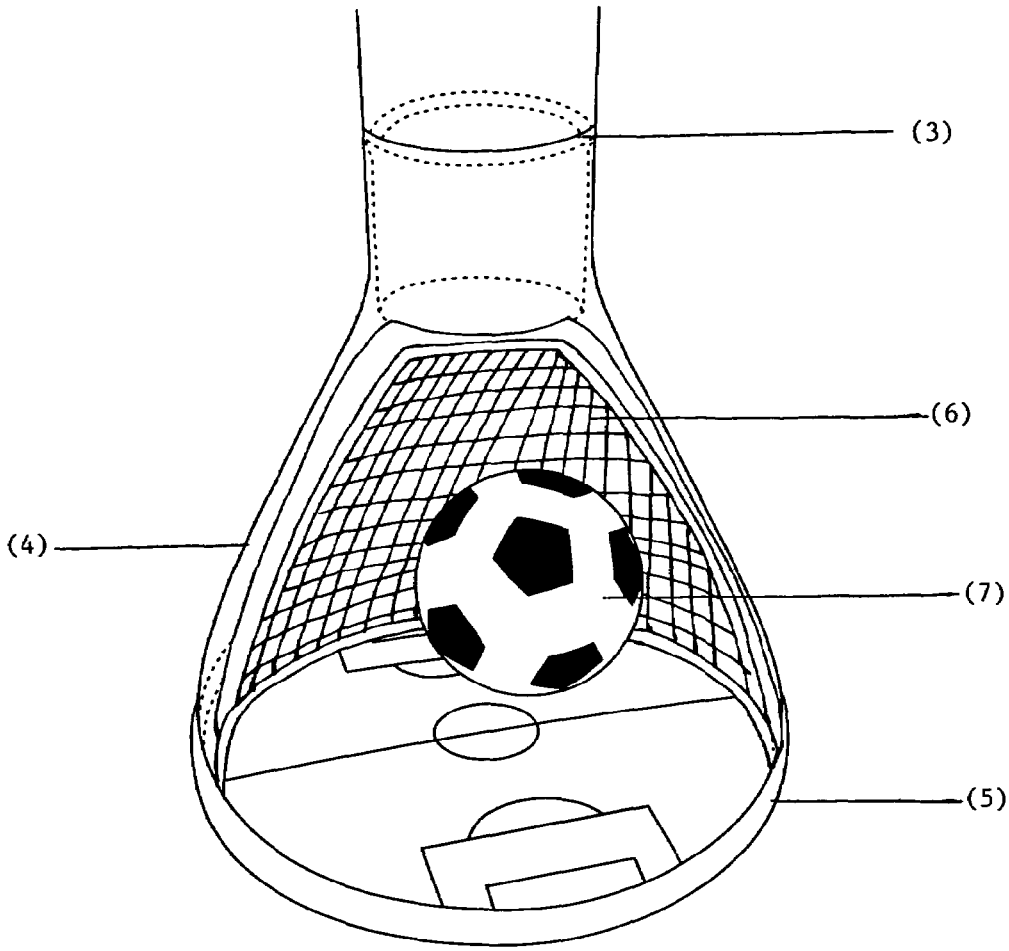
FIGS. 3 to 6 show a number of alternative applications of the invention's container shown in FIGS. 1 and 2.

FIG. 3 shows an application in which the lid and the inner wall of the cavity may have an engraved court and hold an object related thereto, e.g., a soccer court may be engraved on the lid, and the wall of a goalie, placing a soccer ball, which enables the user to have a decorated cup without dumping but keeping the container. Furthermore, the court may be changed depending on the needs, e.g., a basketball, baseball, football, tennis, soccer or otherwise court, so that a decorative object is presented in combination with decorated lid and wall. It may further include diverse designs or figures, whether printed or borne in stickers or labels in the inside or outside.

Figure 4:
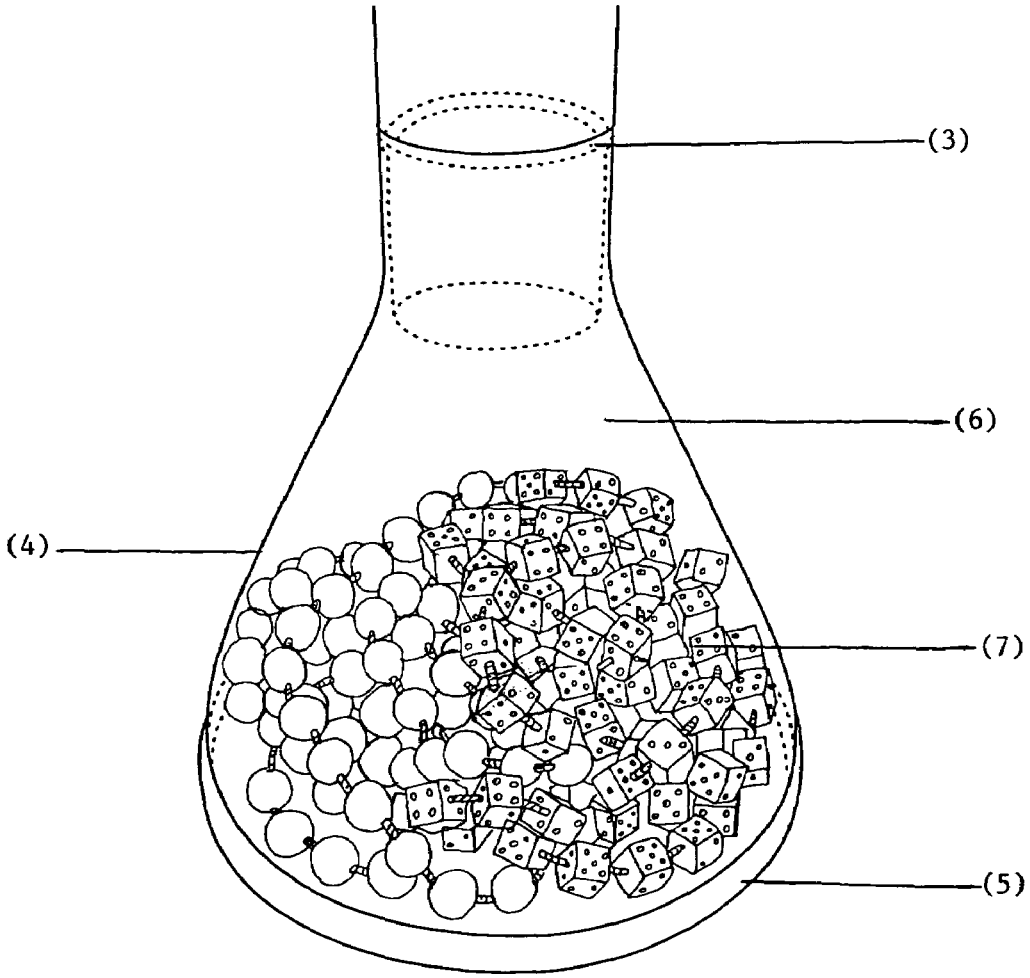

FIG. 4 shows the application of the object or toy, which may be a decorative figure related to the visited place, e.g., a collar, a key chain, a toy, etc., so that the user may access the same by opening the lid and use the object.

Figure 5:
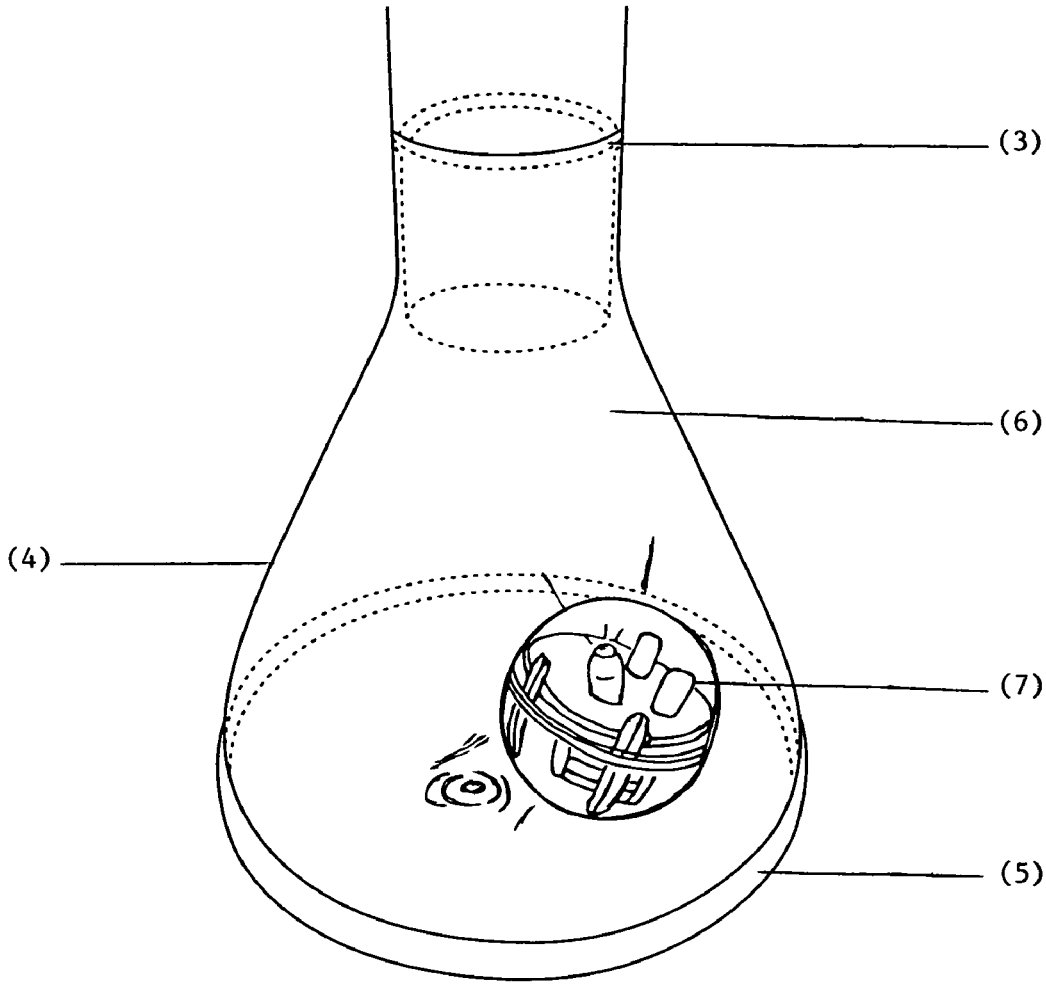

FIG. 5 shows the application of a device shedding light, so that the effect of the light may be an attractive element when providing the beverage to the user and the container may not be dumped. This device may be fixed ~n the cavity or remain movable, e.g., a little ball turning on one or more lights through vibration.

Figure 6:
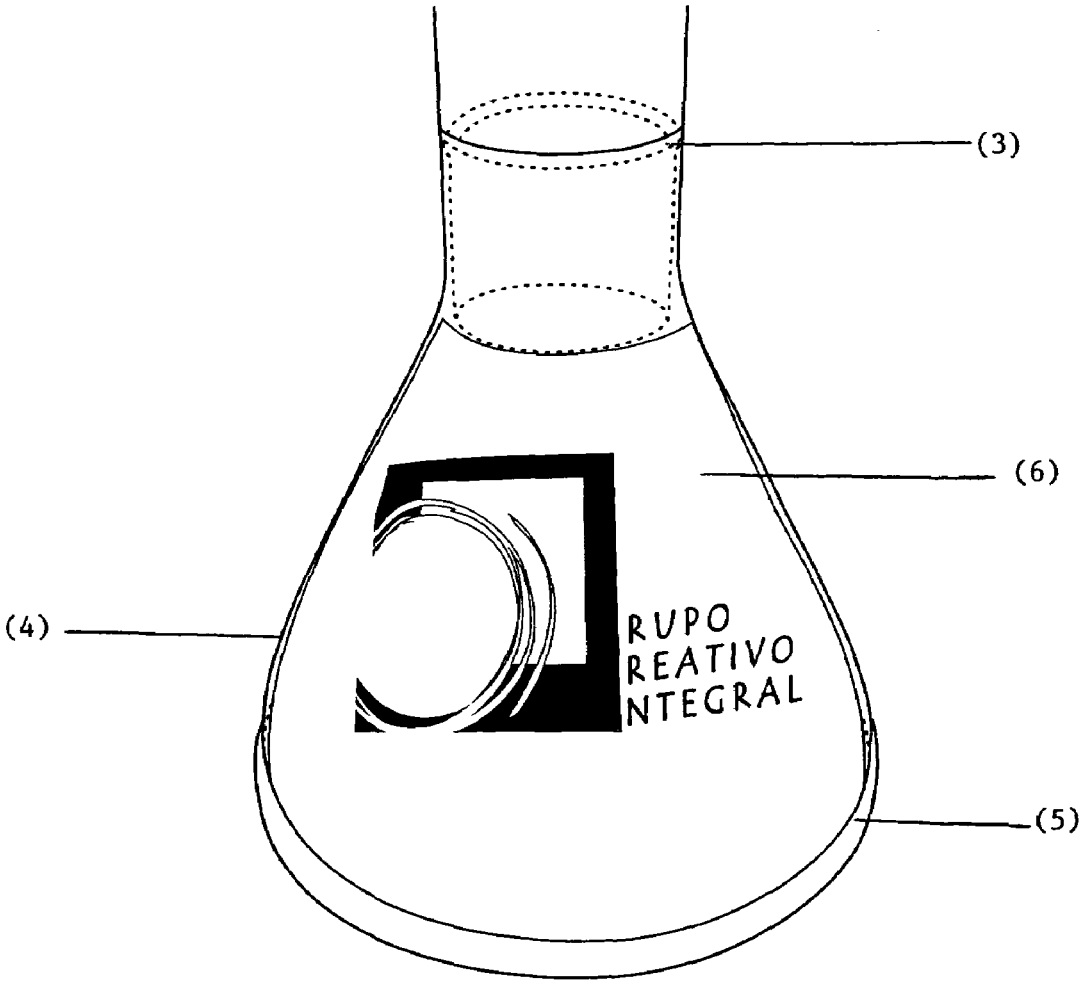

A further form to utilize the cavity is in order to show product advertising, e g., FIG. 6 depicts an application in which a paper or layer may be placed, so that the surface may totally or partially have space for showing a message. This layer is configured to be adapted in the interior of the base of the container, so that the same is adapted to the inner wall of the base and covered with the lid of the container, enabling the user to visually identify the advertising when receiving the beverage. This layer may further be placed on the outside or bear a direct printing, sticker or thermo shrinkable label to accomplish the desired advertising effect. In this case it is evident that the lid may be optional.

Figure 7:
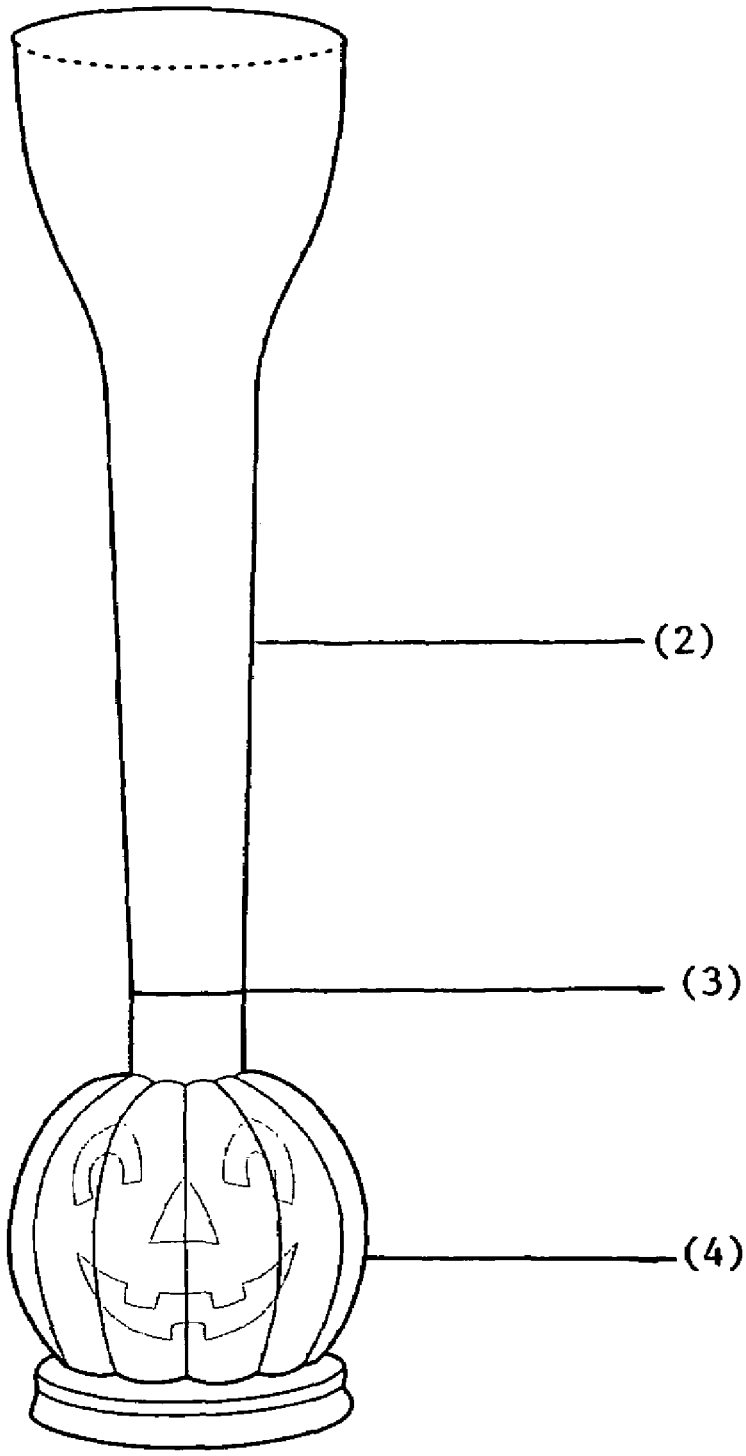
FIG. 7 shows the container according to another embodiment of the present invention.
Figure 8:
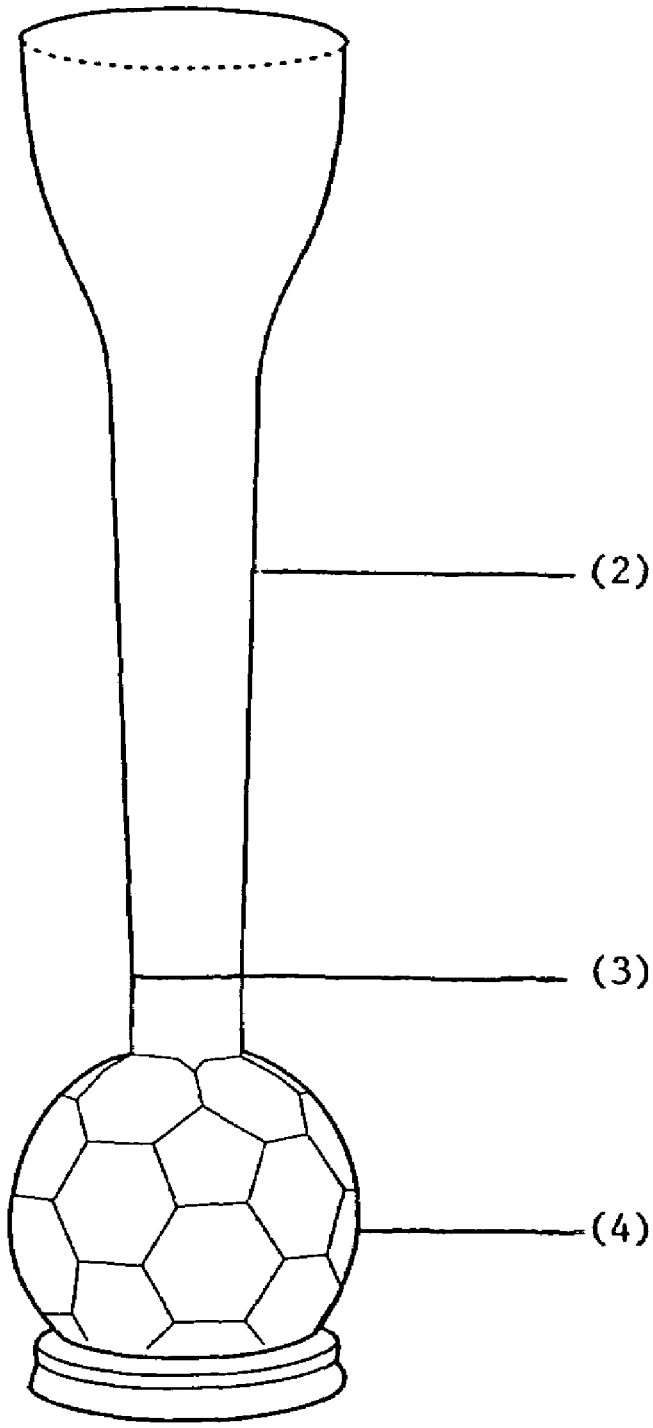
FIG. 8 is another form of the application of the base of the container shown on FIG. 7 of the invention.

Another change that may be established is to have a different outside configuration of the base of the container to be shown, see FIGS. 7 and 8 in which the base of the container has an outside configuration, e.g., a pumpkin face or a soccer ball, which may be replaced by any kind of face or ball. In this case it becomes evident that the lid may be optional.

Figure 9:
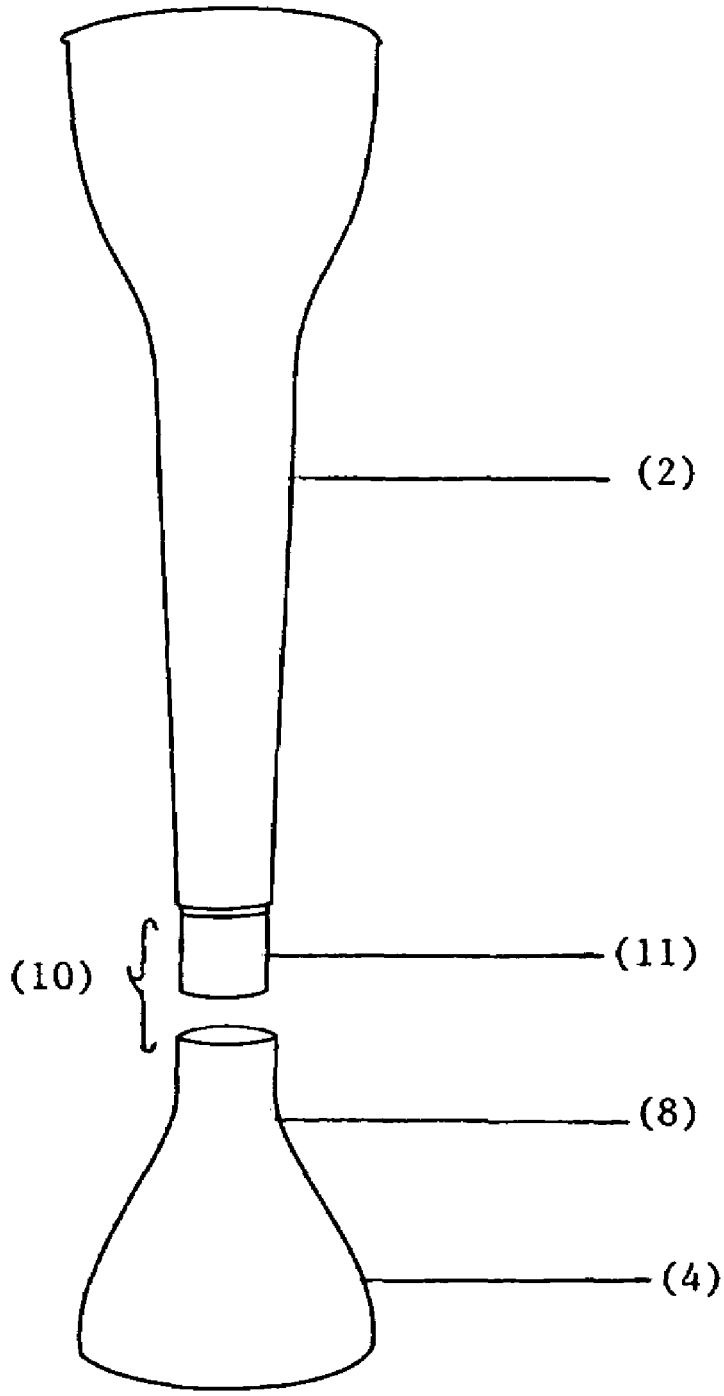
FIG. 9 is an exploded front perspective of the unassembled container with its two parts.

A further embodiment of the invention is shown in FIG. 9, in which the container is not integral or formed from one single piece, this is, the container may be assembled from two parts. The same references defined for the first embodiment are defined in the container, e.g., a yard comprised of three parts: an upper part or cup (2), an intermediate part or joint (3) and a base (4). The upper part of the yard formed from an enlarged body with a bottom part and an open-end upper part whose interior defines a cavity where the beverage shall be containerized. Like in the first embodiment, the upper part of the container may be shaped in the form of a cylinder, quadrangle, oval, rectangle, etc.

Figure 10:
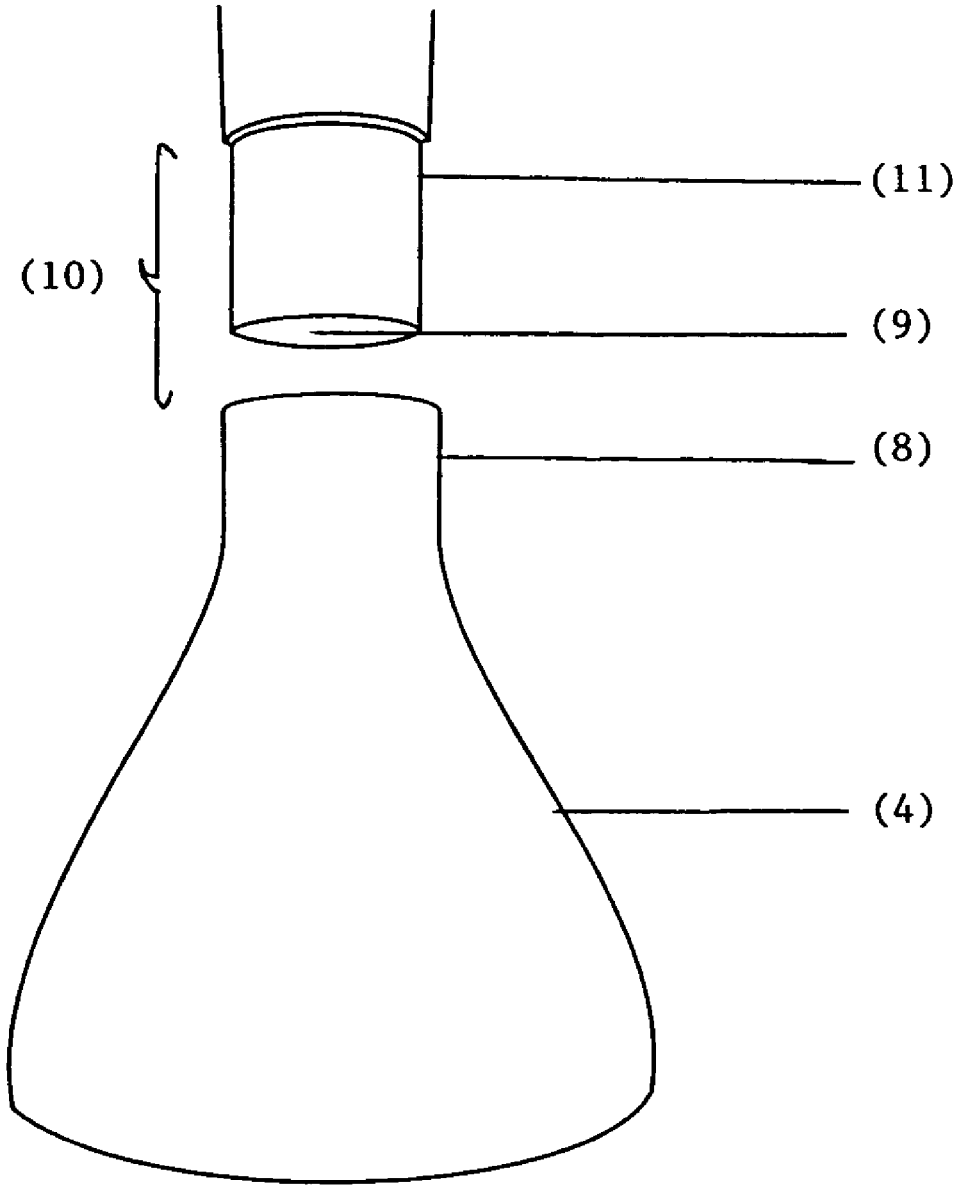
FIG. 10 shows the way in which the upper part or cup shall be attached to the base of the container.

FIG. 10 shows in a detailed manner the upper part or cup (2) referencing the coupling of the cup with the base of the container, specifically called intermediate part or joint (3), whose function is to connect the upper part (2) of the container with the base of the container (4). It is mentioned that the bottom of the cup (2) may be closed, having a wall (9), or open, in which case a cap with a wall (9) is placed to be used as bottom of the cup (2). Any of the aforementioned forms needs to be made in a manner in which the bottom of the cup is hermetically sealed to contain the beverage; the joint (3) may preferentially be a pressure coupling in which a female part (8) and a male part (11) are utilized, so that they supplement each other, and when in contact and pressed against each other the upper part of the container (2) is coupled to the base of the container (4); concerning FIG. 10, this is accomplished by means of a joint (3) formed by a male part (11), including a section with certain height (10) and a female part (8) with a section substantially bigger than the male part (11), so that the same may be introduced into the section of the female part (8) achieving a firm coupling that provides the necessary hardness to the container being used.

It is provided that this embodiment contemplates the most important advantages and simplicity in its manufacturing, since by having the upper part or cup (2) sealed to the base the air tightness necessary to contain the beverage is obtained.

A corresponding container of applicant is disclosed in an application filed concurrently herewith entitled Model of Beverage Container, the disclosure of which is incorporated herein by reference.

What is claimed is:

1. A container with a promotional base for promoting or advertising an object comprising an upper part (2) formed from an enlarged hollow body having a geometrical shape selected from the class consisting of a guadrangle, oval, triangle or circle which defines a cavity in which a beverage is to be containerized with said upper part having one open end which is wider than the enlarged hollow body for drinking said beverage from said container and a closed opposite end, a lower part (4) defining the base of the container and including an enlarged hollow cavity (6) with opposite open ends one of which is of a predetermined female geometry, a joint (3) having a male portion extending from the closed opposite end of the upper part of the container with a geometry substantially matching said predetermined female geometry for coupling the male portion into the base of the container wherein said enlarged hollow cavity (6) in said base includes one or more decorative objects selected from the class consisting of toys, games, balls, sport goods or advertising media with said decorative object(s) being confined within the cavity of said base of the container and a removable lid forming a removable bottom for removably closing the opposite open end of the cavity of said base to provide access thereto for inserting or removing one or more of said decorative objects.

2. A container with a promotional base according to claim 1, wherein the joint (3) is a pressure coupling.

3. A container with a promotional base according to claim 2, wherein the pressure coupling comprises a male part (11), including a section with certain height (10) and a female part (8) with a section substantially longer than the male part (11), so that the male part may be introduced into the section of the female part (8) to establish a firm coupling.

4. A container with a promotional base according to claim 1, wherein one or more of said decorative object contains a source of light.

5. A container with a promotional base according to claim 1, wherein the lid itself contains decorations.

6. A container with a promotional base according to claim 1, wherein the cavity in the base of the container has an inner wall with said one or more of said decorative objects located adjacent the inner wall.

7. A container with a promotional base according to claim 1 that is integral.

8. A container with a promotional base according to claim 1, wherein the lid is fixed to the base of the container through pressure.

9. A container with a promotional base according to claim 1 that is transparent or colored.

10. A container with a promotional base according to claim 1 made of plastic.

* * * * *